US007442056B1

(12) United States Patent
Ju

(10) Patent No.: US 7,442,056 B1
(45) Date of Patent: Oct. 28, 2008

(54) ASSEMBLED ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/078,202

(22) Filed: Mar. 28, 2008

(30) Foreign Application Priority Data

Aug. 22, 2007 (CN) ..... 2007 2 0055895 U

(51) Int. Cl.
*H01R 12/00* (2006.01)

(52) U.S. Cl. ..... 439/79; 439/540.1

(58) Field of Classification Search ..... 439/79, 439/540.1, 541.5, 607–609
See application file for complete search history.

(56) References Cited

U.S. PATENT DOCUMENTS 6,358,067 B1 * 3/2002 Takase et al. ..... 439/79
6,520,802 B1 * 2/2003 Mitra ..... 439/608
6,558,191 B2 * 5/2003 Bright et al. ..... 439/541.5
6,666,716 B2 * 12/2003 Chien-Chung ..... 439/541.5
6,699,068 B2 * 3/2004 Wu ..... 439/541.5
6,827,590 B2 * 12/2004 Huss et al. ..... 439/79
7,207,810 B2 * 4/2007 Kuo et al. ..... 439/79
7,387,517 B2 * 6/2008 Kusuda et al. ..... 439/79

* cited by examiner

*Primary Examiner*—Khiem Nguyen
(74) *Attorney, Agent, or Firm*—Rosenberg, Klein & Lee

(57) ABSTRACT

An assembled electrical connector can be electrically connected with the connection plug. The assembled electrical connector includes an insulating body having a body portion, conducting pins, and a shielding housing. The body portion has pin-receiving channels. The conducting pins are located in the pin-receiving channels. The shielding housing has an opening to be plugged with the connection plug. A receiving space is formed at the front portion of the body portion. The tongue plates are located in the receiving space, and part of projection shadow of the two kinds of connection plugs is overlapped on a plane when the two kinds of connection plugs are assembled with the electrical connector. The electrical connector can be selectively connected with one of two kinds of connection plugs. The height of the electrical connector is reduced while still being able to support two kinds of connection plugs.

10 Claims, 5 Drawing Sheets

ASSEMBLED ELECTRICAL CONNECTOR

BACKGROUND OF THE PRESENT INVENTION

1. Field of the Present Invention

The present invention relates to an assembled electrical connector. In particular, this invention relates to an assembled electrical connector that is selectively connected with one of two kinds of connection plugs.

2. Description of the Related Art

As the digital technology has been developed, the functions of electronic devices are enhanced, such as high resolution, deep color, and high frame rate for digital TV. Furthermore, the performance of consumer electronic devices is improved so that the transmission rate between the consumer electronic device and the computer is also increased. Therefore, the transmission rate of electrical connectors needs to be improved to meet the requirement. As the electronic devices need to be operated at high frequency and transmit the audio and video signals synchronously, High Definition Multimedia Interface (HDMI) connectors become popular. Because the HDMI connector can provide high quality digital audio and video signals, the electronic devices do not need to be installed with both an audio connector and a video connector. The quantity of the connectors is reduced, the transmission speed is high, the frequency is high, and the frame rate is also high.

In order to increase the transmission rate, integrate the peripherals, and make the construction expandable, a new electrical connector (Displayport) is developed. In addition to connect a device with another device, the Displayport can be used as an inner interface of the device. Furthermore, Displayport can be a data interface between two chips.

Because the functions of both connectors' are very good, these two connectors are usually popular. Since the functions of the two connectors are similar, electronic devices are seldom installed with the two connectors simultaneously. However, when two peripherals need to be connected to a computer, the two connectors can be required. Installing two kinds of electrical connectors on the circuit board will occupy space of the circuit board, or the total height is increased. This does not meet the trend of the computer being smaller and thinner.

SUMMARY OF THE PRESENT INVENTION

One particular aspect of the present invention is to provide an assembled electrical connector that can provide interfaces for two kinds of connection plugs, and the total height of the electrical connector is reduced.

The assembled electrical connector can be electrically connected with the two kinds of connection plugs. The assembled electrical connector includes an insulating body having a body portion, a plurality of conducting pins, and a shielding housing assembled on the insulating body. The body portion has a plurality of pin-receiving channels, and the body portion extends to form two tongue plates. The conducting pins are respectively located in the pin-receiving channels. The shielding housing has an opening for inserting of the connection plugs. A receiving space is formed at the front portion of the body portion of the insulating body. The tongue plates are located in the receiving space, and part of projection shadow of the two kinds of connection plugs is overlapped on a plane of the opening when the two kinds of connection plugs are assembled with the electrical connector.

The present invention has the following characteristics. The present invention has two kinds of tongue plates in the receiving space so that it can be selectively connected with one of the two kinds of connection plugs. When the two kinds of connection plugs are assembled with the electrical connector, parts of projection shadow of the two kinds of connection plugs are overlapped on a plane formed by the opening. The height of the electrical connector in the present invention for mating with the two kinds of connection plugs is reduced. Although the electrical connector only can be connected with one kind of connection plug at one time, the electrical connector in the present invention can be selectively connected with one of two kinds of connection plugs without increasing its height. Furthermore, it can meet the requirement of the computer simultaneously supporting two kinds of electrical connectors, including a HDMI connector and a Displayport connector.

For further understanding of the present invention, please refer to the following detailed description illustrating the embodiments and examples of the present invention. The description is only for illustrating the present invention and is not intended to limit the scope of the claim.

BRIEF DESCRIPTION OF THE DRAWINGS

The drawings included herein provide a further understanding of the present invention. A brief introduction of the drawings is as follows.

DETAILED DESCRIPTION OF THE PREFERRED EMBODIMENTS

Figure 1:
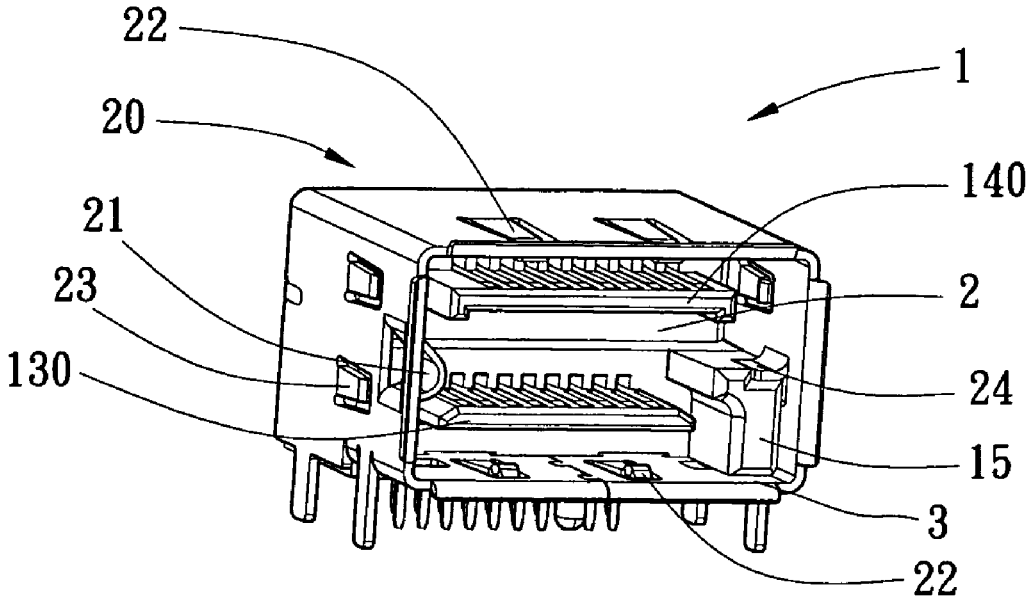
FIG. 1 is a perspective view of an assembled electrical connector of the present invention.
Figure 2:
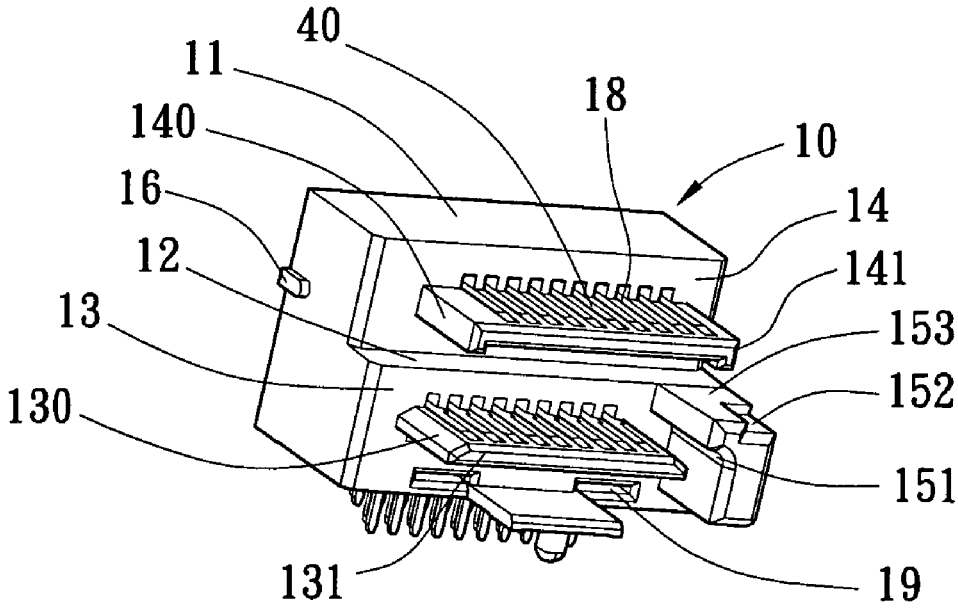
FIG. 2 is a perspective view of an insulating body of the assembled electrical connector as shown in FIG. 1.
Figure 3:
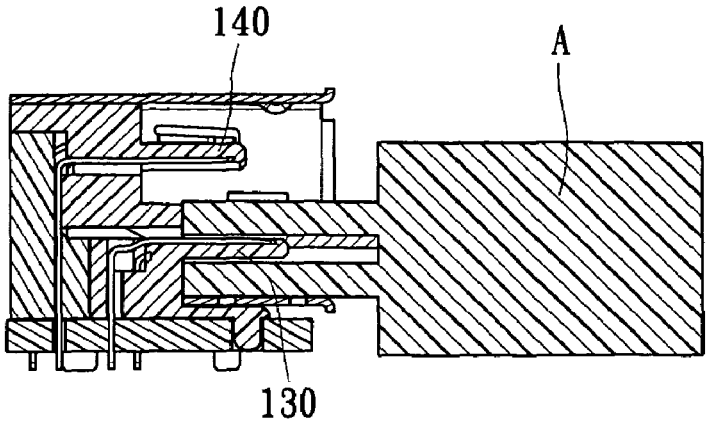
FIG. 3 is a cross-sectional view of the assembled electrical connector as shown in FIG. 1 connecting with a HDMI connection plug.
Figure 4:
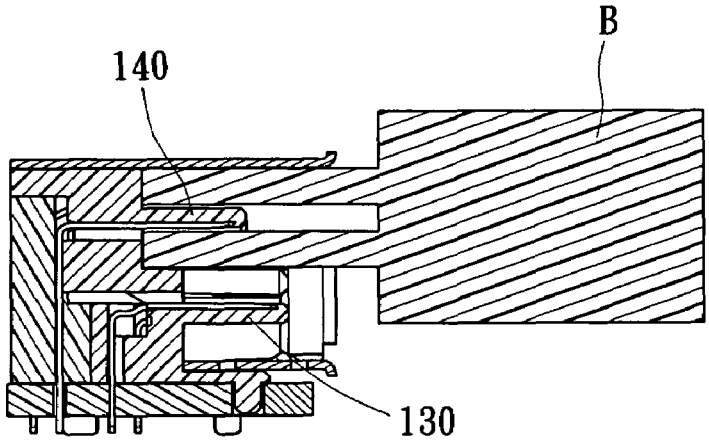
FIG. 4 is a cross-sectional view of the assembled electrical connector as shown in FIG. 1 connecting with a Displayport connection plug.
Figure 5:
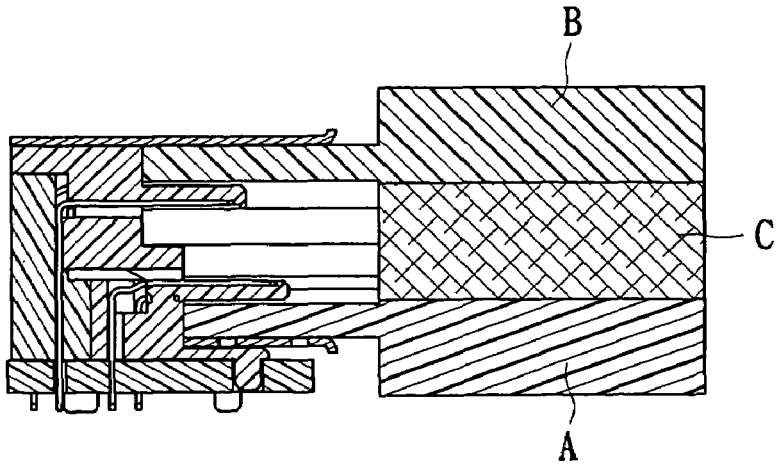
FIG. 5 is a schematic diagram view of the overlapped area on the side direction when the assembled electrical connector as shown in FIG. 1 connecting with two kinds of connection plugs.
Figure 6:
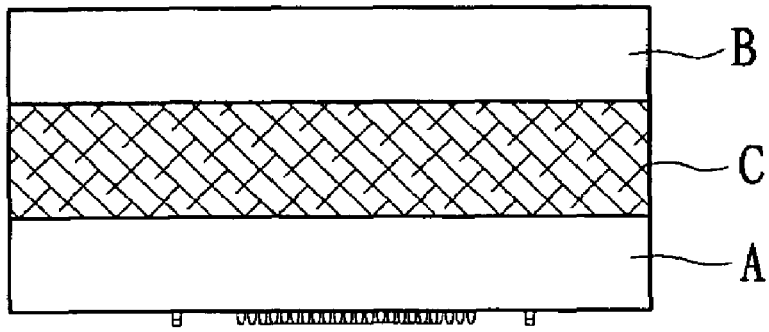
FIG. 6 is a schematic diagram view of the overlapped area on the plane of an opening when the assembled electrical connector as shown in FIG. 1 connecting with two kinds of connection plugs.
Figure 7:
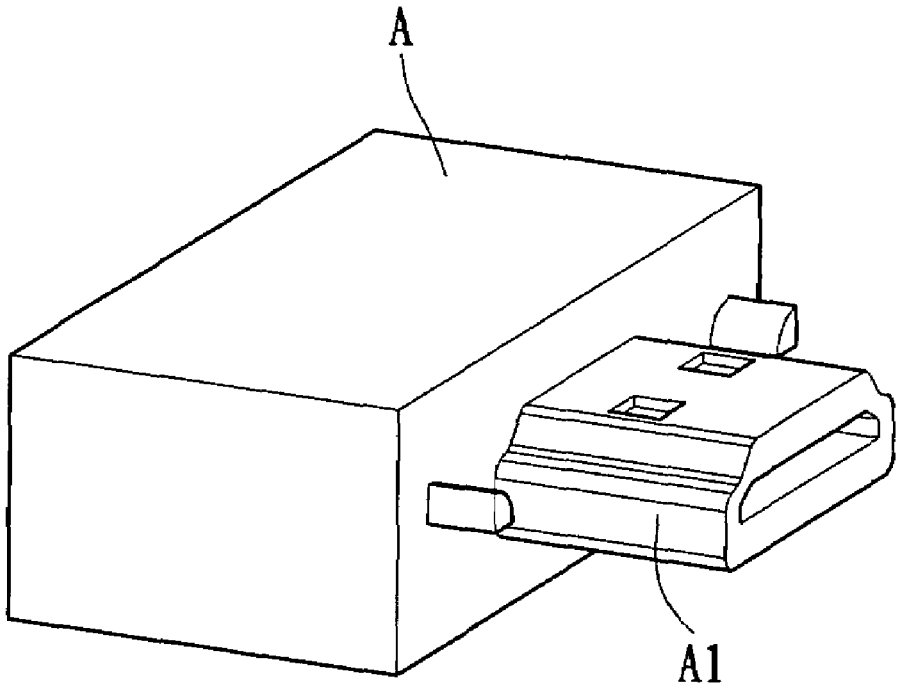
FIG. 7 is a perspective view of the HDMI connection plug.

Please refer to FIGS. 1 and 2. The assembled electrical connector includes an insulating body 10, a plurality of conducting pins 40, and a shielding housing 20. The insulating body 10 has a plurality of pin-receiving channels 18, and the conducting pins 40 are respectively located in the pin-receiving channels. The shielding housing 20 is assembled on the insulating body 10 for Electro Magnetic Interference shielding of the electrical connector 1 and a connection plug. The shielding housing 20 and the insulating body 10 mates with each other to form a receiving space 2 for receiving the connection plug, and the front side of the shielding housing 20 has an opening 3 for inserting of the connection plug.

Please refer to FIGS. 1-7. The insulating body 10 has a body portion 11. One end of the body portion 11 that is close to the receiving space 2 has a ladder portion 12. The ladder portion 12 forms a first mating surface 13 and a second mating surface 14. The first mating surface 13 and the second mating surface 14 respectively partly extend forwards to form two different tongue plates 130, 140. The two tongue plates 130, 140 link to each other and their distance is short. When two connection plugs A, B are plugged into the electrical connector 1, part of their projection shadow on the plane of the opening is overlapped to from an overlapped area C due to the short distance between the two tongue plates 130, 140. Thereby, the total height of the electrical connector 1 is reduced. One of the front end surfaces 131, 141 of the two tongue plates 130, 140 is close to the opening 3, and another one of the front end surfaces 131, 141 of the two tongue plates 130, 140 departs from the opening 3 so as to meet the length specifications of the two kinds of connection plugs A, B. The two tongue plates 130, 140 have a plurality of pin-receiving channels 18 and the quantity and the distance of the pin-receiving channels are matched with the HDMI and Displayport specifications. The conducting pins 40 are respectively located in the pin-receiving channels 18 for electrically connecting the connection plugs A, B.

One side of the first mating surface 13 of the ladder portion 12 of the insulating body 10 extends forwards to form a protruding portion 15. The protruding portion 15 extends from the first mating surface 13 to the opening 3. The inner side of the protruding portion 15 forms an arc matching surface 151 to match the arc fitting surface A1 of the HDMI connection plug A for preventing tongue plate from being damaged due to a wrong assembly of the connection plug. The upper surface of the protruding portion 15 forms a supporting surface 153 to contact the bottom surface of the Displayport connection plug B so that the Displayport connection plug B is firmly received in the receiving space 2. The protruding portion 15 further has a concave slot 152 recessed from the outside surface thereof for matching the shielding housing 20. The first mating surface 13 of the insulating body 10 has two matching holes 19 close to the bottom edge thereof, and the body portion 11 has two matching convex blocks 16 close to the rear end thereof. Both the matching holes and the two matching convex blocks match the shielding housing 20. The insulating housing further includes a plurality of protruding ribs 17 disposed on the rear side of the body portion 11.

Figure 8:
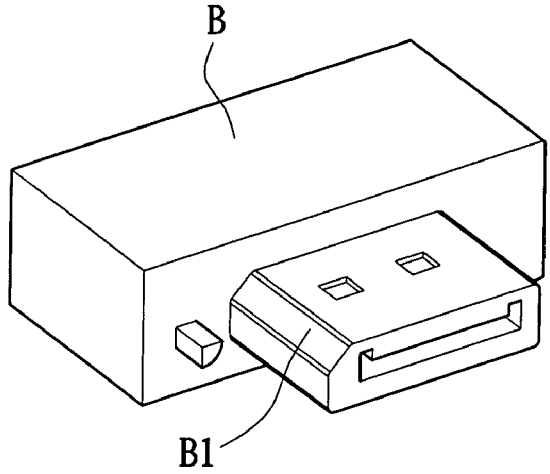
FIG. 8 is a perspective view of the Displayport connection plug.
Figure 9:
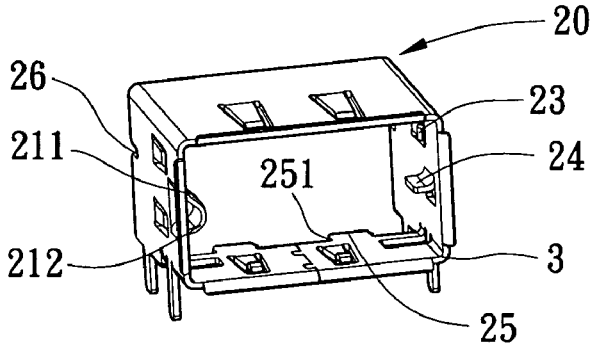
FIG. 9 is a perspective view of a shielding housing of the assembled electrical connector in FIG. 1.
Figure 10:
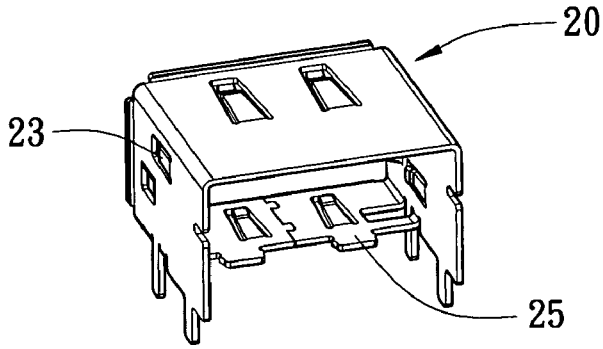
FIG. 10 is another perspective view of the shielding housing of the assembled electrical connector in FIG. 1.
Figure 11:
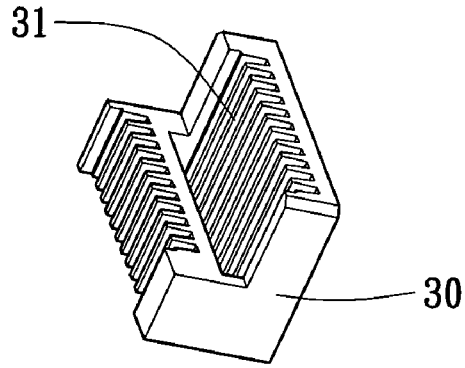
FIG. 11 is a perspective view of a rear stopper of the assembled electrical connector in FIG. 1.
Figure 12:
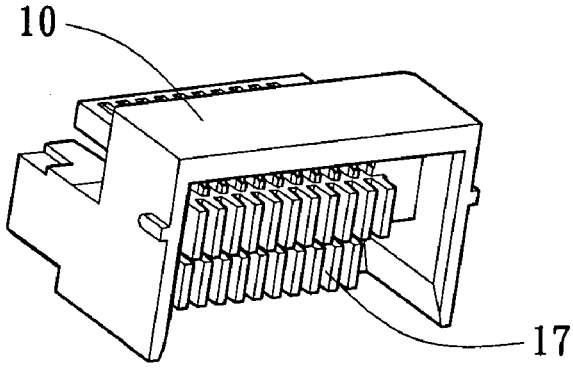
FIG. 12 is another perspective view of the insulating body of the assembled electrical connector in FIG. 1.
Figure 13:
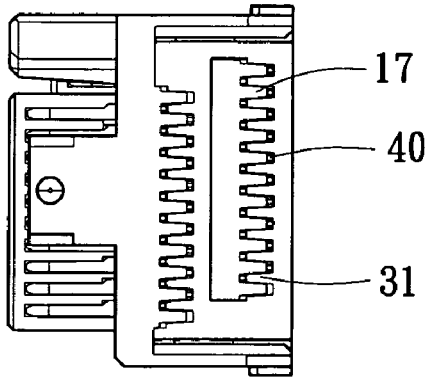
FIG. 13 is a schematic diagram of the insulating body of the assembled electrical connector in FIG. 1 assembled with the rear stopper.

Please refer to FIGS. 8 and 9. The shielding housing 20 is formed by punching a metal plate. The shielding housing 20 has a rectangular opening 3 for inserting of the two kinds of connection plugs A, B. Both the upper surface and the lower surface of the shielding housing 20 have two flexible finger portions 22 respectively that extends into the receiving space 2 to contact the two kinds of connection plugs A, B respectively so that the two kinds of connection plugs A, B are firmly received in the receiving space 2. The flexible finger portions provide insertion and extraction forces for the connection plugs A, B.

One side wall of the shielding housing 20 has a supporting plate 21 that extends into the receiving space 2. The upper surface of the supporting plate 21 is a slanted surface 211. The slanted angle of the slanted surface 211 is similar to the slanted angle of a connection slanted surface B1 located at one side of the Displayport connection plug B, and the slanted surface 211 can prevent the electrical connector from being damaged due to inserting a wrong connection plug which does not match the electrical connector. The lower surface of the supporting plate 21 is an arc matching surface (arc surface) 212 that protrudes downwards and matches the shape of an arc mating surface A1 of the HDMI connection plug A. The arc matching surface 212 mates with the arc mating surface A1 of the HDMI connection plug A so that the HDMI connection plug A is firmly received in the receiving space 2, and can be also used as a proof thinking device. The two side walls of the shielding housing 20 have a plurality of flexible plates 23 respectively. When the connection plugs A, B are plugged into the receiving space 2, the flexible plates 23 contact the shielding housing of the connection plugs A, B so that the electrical connector 1 is electrically connected with the connection plugs A, B.

The bottom surface of the shielding housing 20 further has two fastening portions 25 that can be plugged into the matching hole 19 located at the lower end of the insulating body 10. The fastening portion 25 has at least one wedging portion 251 to fasten with the matching hole 19 so that the shielding housing 20 is fastened onto the insulating body 10 and the shielding housing 20 will not depart from the insulating body 10. Moreover, the rear ends of the two side walls of the shielding housing 20 respectively have a cutout 26 that match the matching convex blocks 16 located at the rear end of the insulating body 10 to prevent the shielding housing 20 from moving backward or vertically relative to the insulating body 10. One side wall of the shielding housing 20 has a pressing flexible plate 24 that is curved and extends into the receiving space 2 to mate with the concave slot 152 located on the upper surface of the protruding portion 15 of the insulating body 10 to prevent the insulating body 10 from rotating backwards when the connection plug is plugged.

Please refer to FIGS. 10~13. The electrical connector further includes a rear stopper 30 that has a plurality of tooth-shaped convex ribs 31 corresponding to the pins. The convex ribs 31 are staggered and mated with the protruding ribs 17 located at the rear side of the insulating body 10 so that the conducting pins 40 are fastened between the tooth-shaped convex ribs 31 of the rear stopper 30 and the protruding ribs 17 of the insulating body 10.

The electrical connector of the present invention has the two kinds of tongue plates 130, 140 in the receiving space 2 so that it can be selectively connected with one of the two kinds of connection plugs. Because the distance between the two tongue plates 130, 140 is short, part of the required space for the two kinds of connection plugs is overlapped. Although the electrical connector only can be connected with one kind of connection plugs at one time, the electrical connector of the present invention has a reduced height and can be selectively connected with one of the two kinds of connection plugs. It can meet the requirement of the computer being smaller and thinner, especially for a laptop.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An assembled electrical connector, electrically connected with two kinds of connection plugs, comprising:

an insulating body having a body portion provided with a plurality of pin-receiving channels, and two tongue plates extending from the body portion;

a plurality of conducting pins respectively located in the pin-receiving channels; and a shielding housing provided with an opening for inserting of the connection plugs and assembled on the insulating body to from a receiving space at the front portion of the body portion; wherein the tongue plates are located in the receiving space, and part of projection shadow of the two kinds of connection plugs is overlapped on a plane of the opening when the two kinds of connection plugs are assembled with the electrical connector.

2. The assembled electrical connector as claimed in claim 1, wherein the two tongue plates respectively match the HDMI specification and the Displayport specification.

3. The assembled electrical connector as claimed in claim 1, wherein a side wall of the shielding housing has a supporting plate that extends into the receiving space.

4. The assembled electrical connector as claimed in claim 3, wherein one end of the supporting plate is a slanted surface.

5. The assembled electrical connector as claimed in claim 3, wherein one end of the supporting plate is an arc surface that protrudes outwards.

6. The assembled electrical connector as claimed in claim 1, wherein the front end of the body portion has a ladder portion.

7. The assembled electrical connector as claimed in claim 6, wherein the ladder portion forms a first mating surface and a second mating surface, and the two tongue plates respectively extend from the first mating surface and the second connection.

8. The assembled electrical connector as claimed in claim 1, wherein the front end of the body portion has a protruding portion that extends forwards.

9. The assembled electrical connector as claimed in claim 8, wherein the protruding portion has an arc matching surface.

10. The assembled electrical connector as claimed in claim 8, wherein the shielding housing has a pressing flexible plate that presses onto the protruding portion.

* * * * *